United States Patent [19]

Asaka et al.

[11] 4,406,087

[45] Sep. 27, 1983

[54] ASEISMATIC DEVICE FOR DOORS

[76] Inventors: Hiroshi Asaka, No. 32-7-305, Komyodai 1-chome, Izumi-shi, Osaka; Michio Nakagawa, 7-1-2512, Takahama-cho, Ashiya-shi, Hyogo-ken, both of Japan

[21] Appl. No.: 409,536

[22] Filed: Aug. 19, 1982

[30] Foreign Application Priority Data

Aug. 19, 1981 [JP] Japan ..... 56-123332[U]

[51] Int. Cl.[3] ..... E06B 7/00

[52] U.S. Cl. ..... 49/70; 49/381; 49/400

[58] Field of Search ..... 49/70, 381, 400

[56] References Cited

U.S. PATENT DOCUMENTS 2,739,341 3/1956 Malcolm ..... 49/381 X 4,073,093 2/1978 Ookawa et al. ..... 49/381

*Primary Examiner*—Philip C. Kannan

*Attorney, Agent, or Firm*—Cantor and Lessler

[57] ABSTRACT

An aseismatic device for a door comprises a main portion and a roller-bearing plate. The main portion includes a plate capable of being attached to one upper corner of one side door, which is to be closed and locked. The plate is provided with a longitudinally rotatable roller in such a manner that it projects somewhat upwardly and with a laterally rotatable roller in such a manner that it projects somewhat laterally.

The roller-bearing plate is capable of being attached to one corner portion of a door frame corresponding to said main portion, and has a pair of planes for bearing said rollers.

The main portion and the roller-bearing plate are arranged in such a manner that the rollers are normally not in contact with said bearing planes.

1 Claim, 7 Drawing Figures

ASEISMATIC DEVICE FOR DOORS

BACKGROUND OF THE INVENTION

The present invention relates to an aseismatic device used with a door.

In the case of buildings inclusive of hotels, in particular multistory buildings, dwellers, residents, workers and so on must escape through their entrances and exits as well as their emergency exits, when an earthquake happens. However, currently available doors make use of door frames which are diagonally transformed by earthquake shocks, as shown in FIGS. 1 and 2. As a result, the doors strike upon their frames, and do not work under loads. In addition, locking latches strike upon their associated members to apply loads to knobs which, then, do not turn. Thus a serious problem arises in connection with safe refuge.

To solve this problem, some sash makers have come up with earthquake-proof steel doors. Although these doors are easily incorporated into new buildings, large-scale construction works and rather considerable expenditures are required to retrofit them into a variety of existing buildings. This prevents the distribution of such doors.

SUMMARY OF THE INVENTION

A main object of the present invention is therefore to provide a novel aseismatic device used with a door, which does not only permit smooth opening and closing of the door even upon receiving an earthquake shock, but is also easily and rapidly attached to a door, whether it is new or not, and can be distributed at low costs with no need of any special lock.

BRIEF DESCRIPTION OF THE DRAWINGS

The above-mentioned and other objects and features of the present invention will become apparent from a reading of the following detailed description of the preferred embodiments according to the present invention with reference to the accompanying drawings, in which.

PREFERRED EMBODIMENTS OF THE INVENTION

Figure 1:
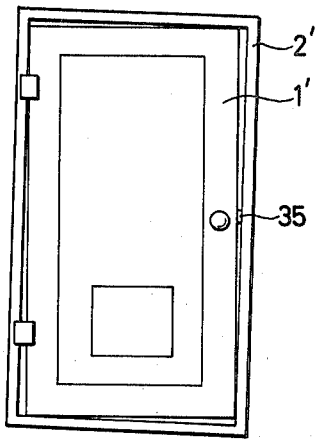
FIGS. 1 and 2 are views showing exaggeratively a door transformed upon an earthquake.
Figure 3:
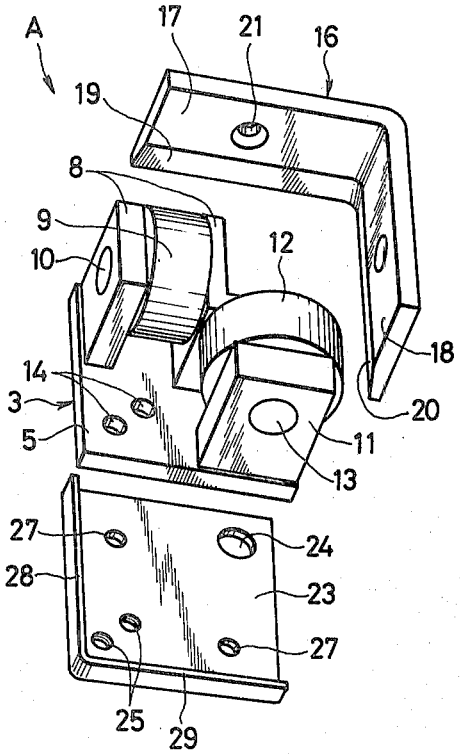
FIG. 3 is an exploded perspective view showing the device according to the present invention.

An existing door and a door frame are shown at 1 and 2, respectively. The door 1 is hinged on its left side, and designed to open outward. An aseismatic device according to the present invention, generally shown at A, is attached to one inside upper corner of the door located on the side of the door to be locked (viz., located opposite to the hinges), and includes a main device 3 and a roller-bearing plate 16. The main device 3 includes a rectangular, upright plate 5 which is provided with an internally threaded hole 7 for a main bolt 6 in the vicinity of its one corner corresponding to the said one upper corner of the door 1. The plate 5 is formed with a pair of longitudinally parallel roller shaft-supporting means 8, 8 at the upper portion of its one side. A longitudinally rotatable roller 9 is supported at 10 between the said pair of means 8 and 8 in such a manner that it projects upwardly to a slight extent. The plate 5 is also formed with a pair of laterally parallel roller shaft-supporting means 11, 11 at the lower portion, under the hole 7, of its one side. A laterally rotatable roller 12 is supported at 13 between the said pair of means 11 and 11 in such a manner that it projects laterally to a slight extent. It should be noted that the bearings used for both rollers 9 and 12 are of the plane type, rather than of the ball or roller type.

Furthermore, the upright plate 5 is formed with two holes 14, 14, internally threaded, for bolts 15 in the vicinity of its one corner opposite to the said hole 7.

A roller-bearing plate 16 is of a L shape, and has a given thickness. This plate 16 has its lower plane serving as a longitudinal roller-bearing plane 17 and its side plane, contiguous thereto, serving as a lateral roller-bearing plane 18. The bearing planes 17 and 18 are inclined at 19 and 20, respectively, to reduce an amount of resistance applied to the rollers. The L-shaped plate 16 is attached to the door frame 2 by bolts 22 inserted through holes 21.

An auxiliary plate, generally shown at 23, has a size virtually identical with that of the upright plate 5, since it is adapted to be disposed between the upright plate 5 and the door 1. This auxiliary plate has therein a hole 24 in association with the said hole 7 and an internally threaded hole 25 in association with the said hole 14 as well as a hole 27 through which a bolt 26 is inserted to attach it to the door 1. The plate 23 is further folded at its two edges 38 and 29 which are engaged with the relative end faces of the upright plate 5. A reinforcing plate 30 is provided so as to receive the head of the main bolt 6 at the outer face of the door 1.

A covering 31 for the main device 3 is open at its upper and side portions corresponding to the rollers 9 and 12, and is engageable with the edge of the upright plate 5.

The aseismatic device A is attached to an existing door in the following manner.

When the door is designed to open outward, the L-shaped roller-bearing plate 16 is attached by means of the bolt 22 to the inside corner of the frame 2 corresponding to the side of the door to be locked.

The roller-bearing plate 16 then has its inclined planes 19 and 20 facing the inside of the door 1, and is arranged in such a manner that it does not prevent complete closing of the door 1. The main device 3 is subsequently attached to the inside corner of the door 1 corresponding to the said inside corner of the frame 2. To this end, the door 1 is provided with holes 32 and 32 for the main bolt 6, and with an internally threaded hole 27 for the auxiliary plate 23. The auxiliary plate 23 is first attached to the door 1 by means of the bolt 26. Next, the upright plate 5 of the main device 3 is put above the auxiliary plate 23, and the main bolt 6 is inserted through the respective holes 32, 32, 24 and 7 from the outside of the door 1 for threaded engagement with a nut 33 placed on the inside of the door 1. The bolt 15 is threadedly inserted from the hole 25 in the plate 22 through the hole 34 in the door 1 so as to attach the main device 3 to the door 1. It should be noted that the longitudinal roller 9 and the lateral roller 12 of the main device 3 be spaced away from the roller-bearing planes 17 and 18 of the roller-bearing plate 16 by given distances indicated by s and t of the order of 1.5 mm to assure that they are normally not in contact with each other. Finally, the covering 31 is attached to the main device 3 in such a manner that the rollers 9 and 12 project therefrom.

Figure 2:
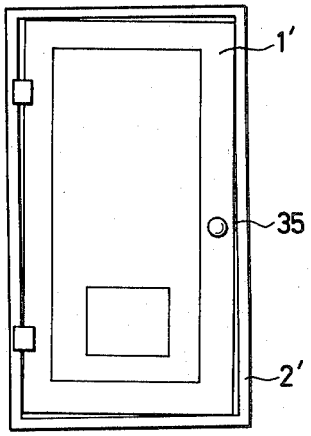
Figure 4:
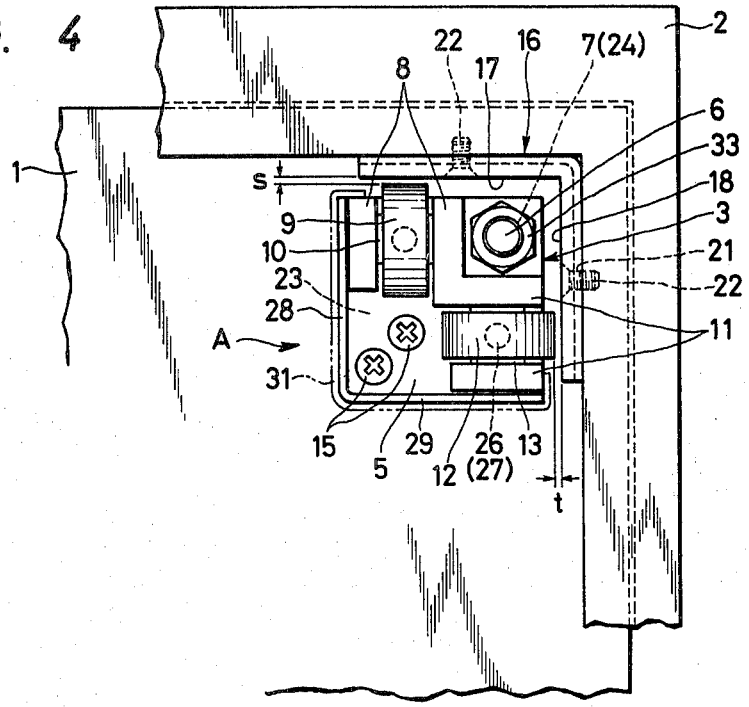
FIG. 4 is a front view showing the present device attached to a door.

Upon being subjected to vibrations and loads resulting from an earthquake, the door frame 2 tends to be transformed, as illustrated in FIGS. 1 and 2. An ordinary door 1' will then strike upon its door frame 2' to such an extent that it will not work under loads. A latch of a lock 35 will also strike upon its associated member, whereby a knob will not turn under loads and, eventually, the door 1' will not work.

With the present devide A attached to a door, as shown in FIG. 1, however, no downward transformation of the upper portion of the door frame 2 located on the side of the door 1 to be locked will take place even upon being subjected to vibrations and loads resulting from an earthquake, since the present device A will then support the said portion of the frame 2 at its longitudinal roller 9 through the bearing plane 17 of the roller-bearing plate 16.

Thus, the overall transformation of the door frame 2 will be avoided. In addition, the door 1 will easily be opened by rotation of the roller 9 in contact with the door frame 2.

It is also possible to prevent the upper side portion of the door frame 2, which is located on the side of the door 1 to be locked, from being transformed toward the door 1, as shown in FIG. 2. This is because the present device A then supports that portion of the door frame 2 at its lateral roller 12 through the bearing plane 18 of the roller-bearing plate 16. Thus, it is possible to prevent the overall transformation of the door frame 2. In addition, the present device A provides easy opening of the door 1 by rotation of the lateral roller 12.

In either case, the knob easily turns since no load is applied to the latch of the lock from its associated member due to the prevention of transformation of the door frame 2. Thus, there is no possibility that the door 1 may not work due to lock troubles.

Figure 5:
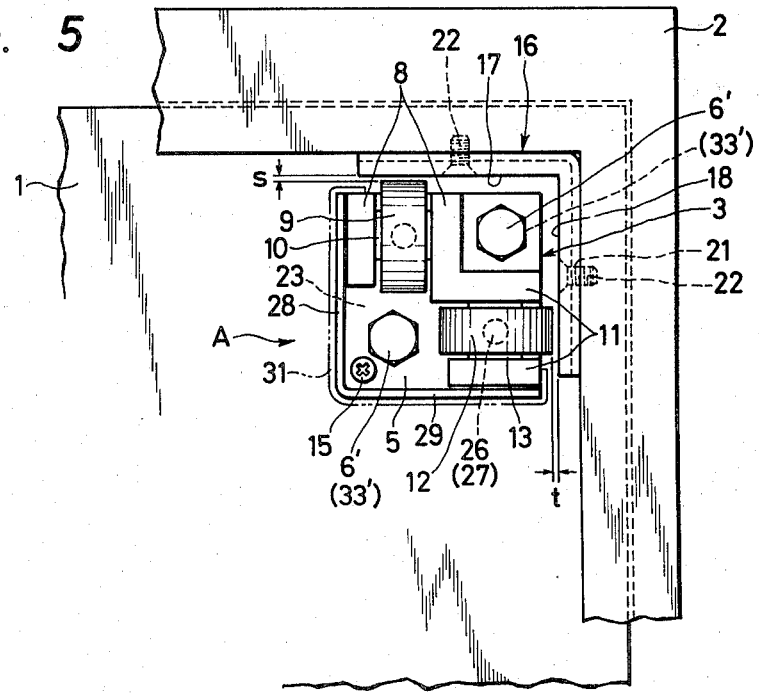
FIGS. 5 and 7 show a modification of the means for the attachment of the present device to the door.
Figure 6:
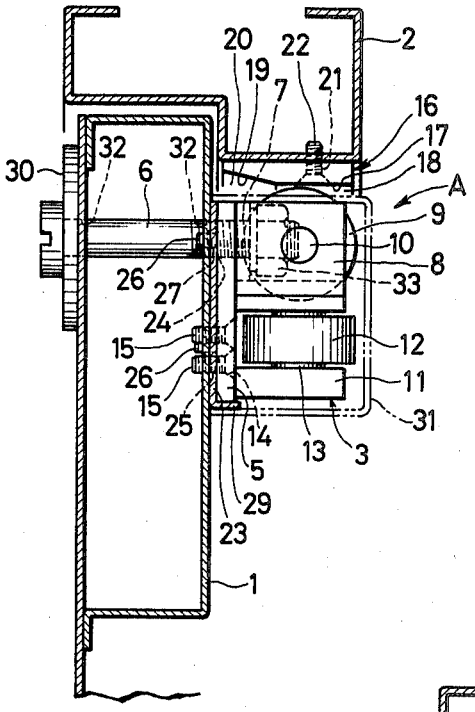
FIG. 6 is a left side view, partially sectioned of the present device attached to a door.
Figure 7:
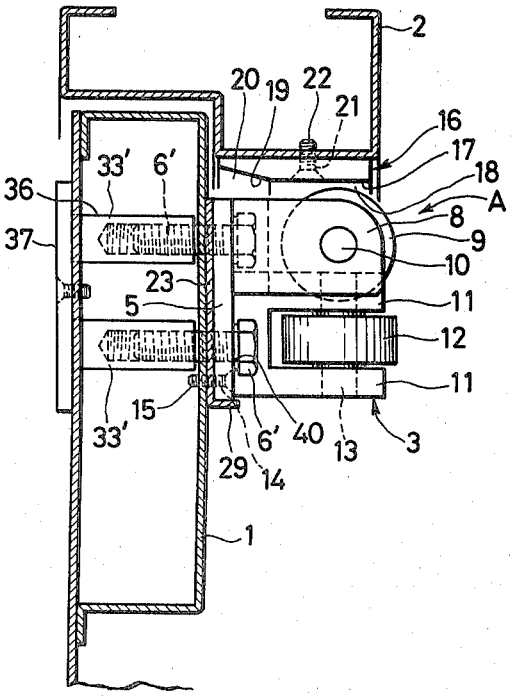

The means for the attachment of the present device A to the door 1 may be modified, as shown in FIGS. 5 and 7.

A pair of nut members 36 include a pair of cylindrical nut portions 33' attached to a side plate 37, each having a length substantially equal to the thickness of the door 1. The cylindricl nut portions 33' are inserted through the door 1 from the outside to the inside. A pair of main bolts 6' are inserted through a pair of holes 40 provided in the upright plate 5, i.e., the upper portion of the plate 5 and the portion opposite thereto, for threaded engagement with the nut portions 33'. This arrangement is designed to provide easy attachment of the present device A to the door 1 and to increase the lateral strength of the portion of the door 1, to which the present device A is attached.

It is noted that roller-supporting means 8 and 11 have a length slightly larger than that of the foregoing means, as viewed in the inward direction, so that the rollers 9 and 12 are retracted. This is to retract the points of contact of the rollers 9, 12 with the roller-bearing plate 16.

While the present invention has been illustrated with reference to the embodiments wherein the door is designed to open outward, and the present device is attached to the inside of the door, it will be understood that the present device may be attached to the outside of the door, when it is designed to open inward. It is also possible to use a suitable number of longitudinal and lateral rollers.

As mentioned above, the device according to the present invention prevents any transformation of the door frame due to an earthquake, and assures smooth opening and closing of the door through rotation of the lateral and longitudinal roller. According to the present invention, any special lock is dispensed with, since no load is applied to the lock. To add to this, the present device can easily be attached to not only a new door but also an existing door at a low cost.

What is claimed is:

1. An aseismatic device for a door comprising a main portion 3 and a roller-bearing plate 16, wherein said main portion 3 includes a plate 5 capable of being attached to one upper corner of one side of said door, which is to be closed and locked, said plate 5 being provided with a longitudinally rotatable roller 9 in such a manner that it projects somewhat upwardly and with a laterally rotatable roller 12 in such a manner that it projects somewhat laterally; and wherein said roller-bearing plate 16 is capable of being attached to one corner portion of a door frame corresponding to said main portion 3, and has a pair of planes 17 and 18 for bearing said rollers 9 and 12;

said main portion 3 and said roller-bearing plate 16 being arranged in such a manner that said rollers 9 and 12 are normally not in contact with said bearing planes 17 and 18.

* * * * *